US008363003B2

(12) United States Patent
Kwon et al.

(10) Patent No.: US 8,363,003 B2
(45) Date of Patent: Jan. 29, 2013

(54) METHOD OF DRIVING LIQUID CRYSTAL DISPLAY DEVICE

(75) Inventors: Kyung-Joon Kwon, Seoul (KR); Hee-Won Ahn, Gyeonggi (KR); Sung-Soo Kim, Gyeonggi (KR)

(73) Assignee: LG Display Co., Ltd., Seoul (KR)

( * ) Notice: Subject to any disclaimer, the term of this patent is extended or adjusted under 35 U.S.C. 154(b) by 1134 days.

(21) Appl. No.: 12/289,212

(22) Filed: Oct. 22, 2008

(65) Prior Publication Data

US 2009/0109170 A1 Apr. 30, 2009

(30) Foreign Application Priority Data

Oct. 25, 2007 (KR) ..... 10-2007-0107878

(51) Int. Cl.
*G09G 3/36* (2006.01)

(52) U.S. Cl. ..... 345/102; 345/690; 345/695

(58) Field of Classification Search ..... None
See application file for complete search history.

(56) References Cited

U.S. PATENT DOCUMENTS 5,469,188 A * 11/1995 Krishnamurthy et al. .... 345/618
5,760,756 A * 6/1998 Kobayashi et al. ..... 345/87
2006/0017746 A1* 1/2006 Weithbruch et al. ..... 345/616
2006/0170710 A1* 8/2006 Chao et al. ..... 345/660
2006/0262147 A1* 11/2006 Kimpe et al. ..... 345/690
2006/0284818 A1* 12/2006 Tomita ..... 345/98

* cited by examiner

*Primary Examiner* — Sumati Lefkowitz
*Assistant Examiner* — Jesus Hernandez
(74) *Attorney, Agent, or Firm* — Morgan, Lewis & Bockius LLP

(57) ABSTRACT

A method of driving a liquid crystal display device includes inputting source image data, each of which has one of m gray level values, wherein m is a natural number, defining T error data from the source image data, wherein the error data have top k gray level values, and T and k are a natural number, generating conversion image data having larger gray level values than the source image data using one having a largest gray level value from the source image data excluding the error data, inputting the conversion image data to a liquid crystal panel, controlling a brightness of a backlight unit in accordance with the conversion image data, forming a bitmap corresponding to the conversion image data, wherein the bitmap shows positional distribution of pixels with the error data, counting error areas by scanning the bitmap, wherein each of the error areas includes the predetermined number of the pixels having the error data, and controlling the T according to the number of the error.

12 Claims, 8 Drawing Sheets

| | | | | | | | | | | |
|---|---|---|---|---|---|---|---|---|---|---|
| 0 | 0 | 1 | 1 | 0 | 0 | 0 | 0 | 1 | 0 | 0 |
| 0 | 1 | 0 | 0 | 1 | 1 | 0 | 0 | 1 | 0 | 0 |
| 1 | 0 | 0 | 0 | 0 | 0 | 0 | 0 | 0 | 1 | 1 |
| 1 | 1 | 1 | 0 | 0 | 0 | 1 | 0 | 1 | 0 | 0 |
| 0 | 1 | 1 | 0 | 0 | 0 | 1 | 0 | 1 | 0 | 0 |
| 1 | 0 | 0 | 0 | 0 | 0 | 0 | 1 | 0 | 0 | 0 |
| 0 | 0 | 0 | 0 | 0 | 0 | 0 | 1 | 0 | 0 | 0 |

METHOD OF DRIVING LIQUID CRYSTAL DISPLAY DEVICE

This application claims the benefit of Korean Patent Application No. 10-2007-0107878, filed on Oct. 25, 2007, which is hereby incorporated by reference for all purposes as if fully set forth herein.

BACKGROUND OF THE INVENTION

1. Field of the Invention

The present invention relates to a method of driving a display device, and more particularly, to a method of driving a liquid crystal display device that improves degradation of an image quality and reduces power consumption of a backlight unit.

2. Discussion of the Related Art

Liquid crystal display (LCD) devices produce images by applying an electric field to a liquid crystal material, which has dielectric anisotropy and is interposed between two substrates, controlling intensity of the electric field, and adjusting an amount of light transmitted thought the substrates.

An LCD device includes a liquid crystal panel having two substrates and a liquid crystal layer interposed therebetween. A plurality of gate lines are formed on one of the two substrates, and a plurality of data lines are insulated from and cross the plurality of gate lines. Pixels are defined by the gate lines and the data lines. A thin film transistor is disposed at each crossing of the gate lines and the data lines.

The LCD device further includes a backlight unit for providing light to the liquid crystal panel. Power consumption of the backlight unit is as high as the backlight unit occupies about 70 to 80 percent of a total power of a liquid crystal display device in small devices of less than 10 inches such as cellular phones.

Recently, to reduce the power consumption of the backlight unit, various methods have been proposed. Hereinafter, a method of driving a liquid crystal display device according to a first embodiment of the related art, which may be referred to as "frame maximum data method," will be described with reference to FIG. 1. is a flow chart of illustrating a method of driving an LCD device according to a first embodiment of the related art.

At step st1, source image data Ds corresponding to one frame, each of which has one of m gray level values (m is a natural number), are inputted as n bit digital data (n is a natural number) from exterior circuits such as a timing controller. Here, m is $2^n$, and the inputted source image data Ds are R, G, and B color image data that are supplied to a liquid crystal panel to produce an image. For example, in a QVGA (Quarter Video Graphics Array) model having 320×240 pixels, each of which includes three sub-pixels, the number of the source image data Ds is 76,800×3.

At step st2, a maximum image data Dmax is determined by detecting one having the largest gray level value from the source image data Ds.

Next, at step st3, the maximum image data Dmax is data-modulated such that the maximum image data Dmax has the maximum gray level value, that is, the mth gray level value, and thus a modulation factor s is calculated. The modulation factor s has the same meaning as a gain.

At step st4, conversion image data Dc are generated by data-modulating each of the source image data Ds s times. For example, in the QVGA model, each of 76,800×3 source image data is data-modulated by s times.

Through the steps st1 to st4, the source image data Ds are converted to the conversion image data Dc having increased gray level values.

At step st5, the conversion image data Dc are inputted into the liquid crystal panel to display an image. Accordingly, the image displayed on the liquid crystal panel by the conversion image data Dc has a higher brightness than an image by the source image data Ds.

At step st6, a brightness of a backlight unit is controlled by the modulation factor s, which is used for generating the conversion image data Dc. Here, the brightness of the backlight unit may be controlled to decrease by 1/s times or more than 1/s times.

According to the method of driving an LCD device of the first embodiment of the related art, the power consumption of the LCD device decreases by about 20 percent without lowering the image quality. Thus, driving time of the LCD device in small models can be further extended.

FIG. 2 is a flow chart of illustrating a method of driving an LCD device according to a second embodiment of the related art. FIG. 3 is a view of illustrating a histogram for source image data in a method of driving an LCD device according to the second embodiment of the related art, and FIG. 4 is a view of illustrating a histogram for conversion image data in a method of driving an LCD device according to the second embodiment of the related art.

At step st11, source image data Ds corresponding to one frame, each of which has one of m gray level values (m is a natural number), are inputted as n bit digital data (n is a natural number) from exterior circuits such as a timing controller. Here, m is $2^n$, and the inputted source image data Ds are R, G, and B color image data that are supplied to a liquid crystal panel to produce an image. For example, the source image data Ds may be 8 bit digital image data for 256 gray levels. That is, n may be 8, and m may be 256.

Next, at step st12, referring to FIG. 3, T source image data (T is a natural number), which have top some gray level values from the largest gray level value, are defined as error data Er. The number of the error data Er, that is, T can be changed according to a designer.

At step st13, a modulation factor s is calculated by a maximum image data Dmax having the largest gray level value from the source image data Ds excluding the error data Er, and conversion image data Dc are generated through the above-mentioned steps st3 and st4. A histogram of the conversion image data Dc is shown in FIG. 4.

At step st14, the conversion image data Dc are inputted into the liquid crystal panel to display an image.

At step st15, a brightness of a backlight unit is controlled by the modulation factor s.

In the second embodiment of the related art, since the inputted data are data-modulated after the error data Er are determined from the inputted data, the modulation factor is larger than that of the first embodiment of the related art. In proportion to this, the power consumption of the backlight unit is further reduced as compared with the first embodiment of the related art.

By the way, the error data Er are data-modulated such that the data-modulated error data have the maximum gray level value, that is, the mth gray level value due to gray saturation properties.

If the error data are densely disposed in a certain region of the liquid crystal panel, the region may be displayed relatively brightly and may be easily recognized by a viewer. This may cause degradation of the image quality.

SUMMARY OF THE INVENTION

Accordingly, the present invention is directed to a method of driving a liquid crystal display device that substantially obviates one or more problem due to limitations and disadvantages of the related art.

An advantage of the invention is to provide a method of driving a liquid crystal display device that further decreases the power consumption of the backlight unit and improves degradation of an image quality.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method of driving a liquid crystal display device includes inputting source image data, each of which has one of m gray level values, wherein m is a natural number, defining T error data from the source image data, wherein the error data have top k gray level values, and T and k are a natural number, generating conversion image data having larger gray level values than the source image data using one having a largest gray level value from the source image data excluding the error data, inputting the conversion image data to a liquid crystal panel, controlling a brightness of a backlight unit in accordance with the conversion image data, forming a bitmap corresponding to the conversion image data, wherein the bitmap shows positional distribution of pixels with the error data, counting error areas by scanning the bitmap, wherein each of the error areas includes the predetermined number of the pixels having the error data, and controlling the T according to the number of the error.

In another aspect, a method of driving a liquid crystal display device includes receiving one of ON and OFF signals, wherein when the ON signal is received, the method includes inputting source image data, each of which has one of m gray level values, wherein m is a natural number, defining T error data from the source image data, wherein the error data have top k gray level values, and T and k are a natural number, generating conversion image data having larger gray level values than the source image data using one having a largest gray level value from the source image data excluding the error data, inputting the conversion image data to a liquid crystal panel, controlling a brightness of a backlight unit in accordance with the conversion image data, forming a bitmap corresponding to the conversion image data, wherein the bitmap shows positional distribution of pixels with the error data, counting error areas by scanning the bitmap, wherein each of the error areas includes the predetermined number of the pixels having the error data, and controlling the T according to the number of the error areas, and wherein when the OFF signal is received, the method includes inputting source image data to the liquid crystal panel.

In another aspect, a liquid crystal display device comprising a means for changing a method of driving the liquid crystal display device according to ON and OFF signals.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, an example of which is illustrated in the accompanying drawings.

Figure 1:
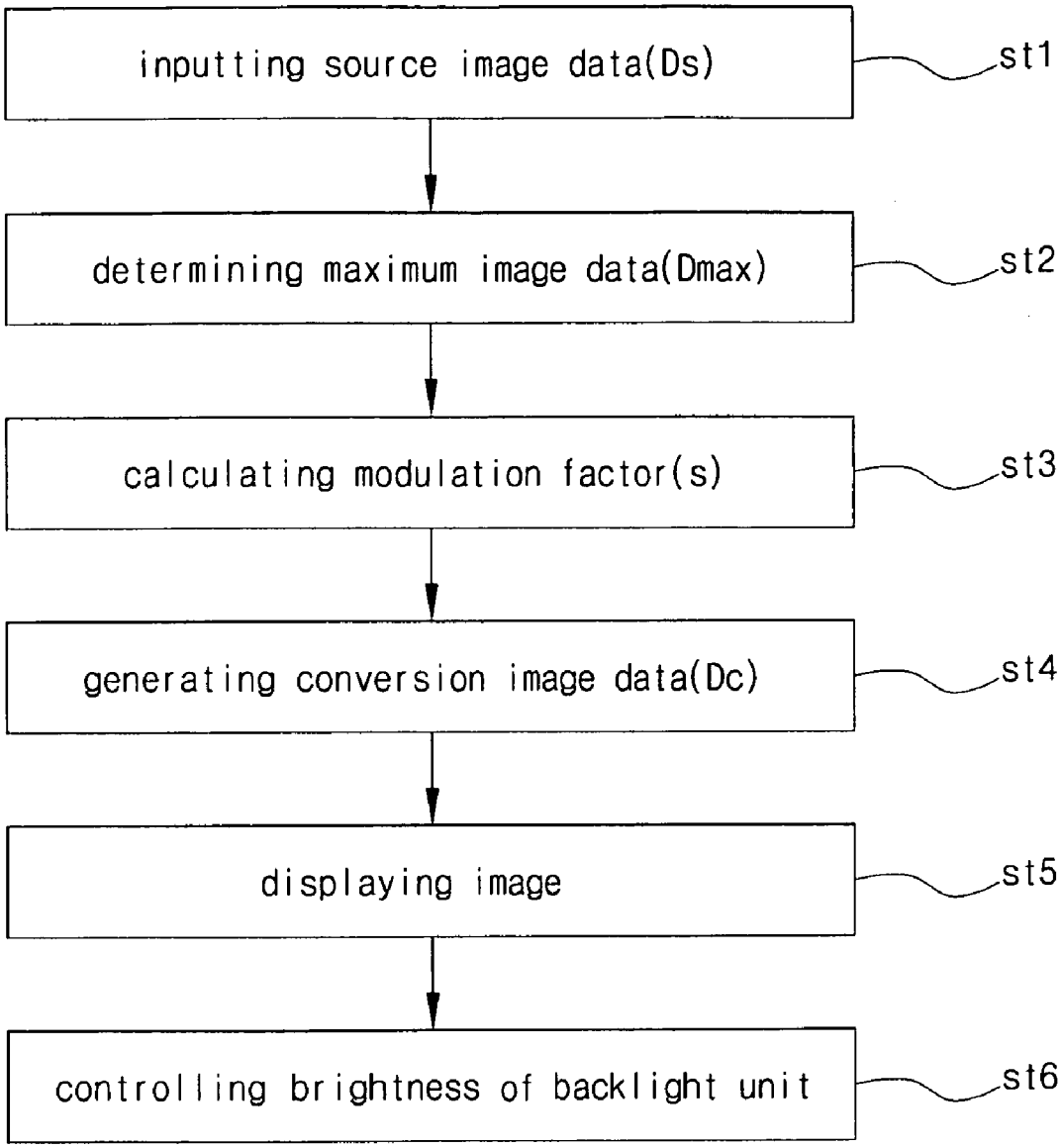
FIG. 1 RELATED ART
FIG. 1 is a flow chart of illustrating a method of driving a liquid crystal display (LCD) device according to a first embodiment of the related art.
Figure 2:
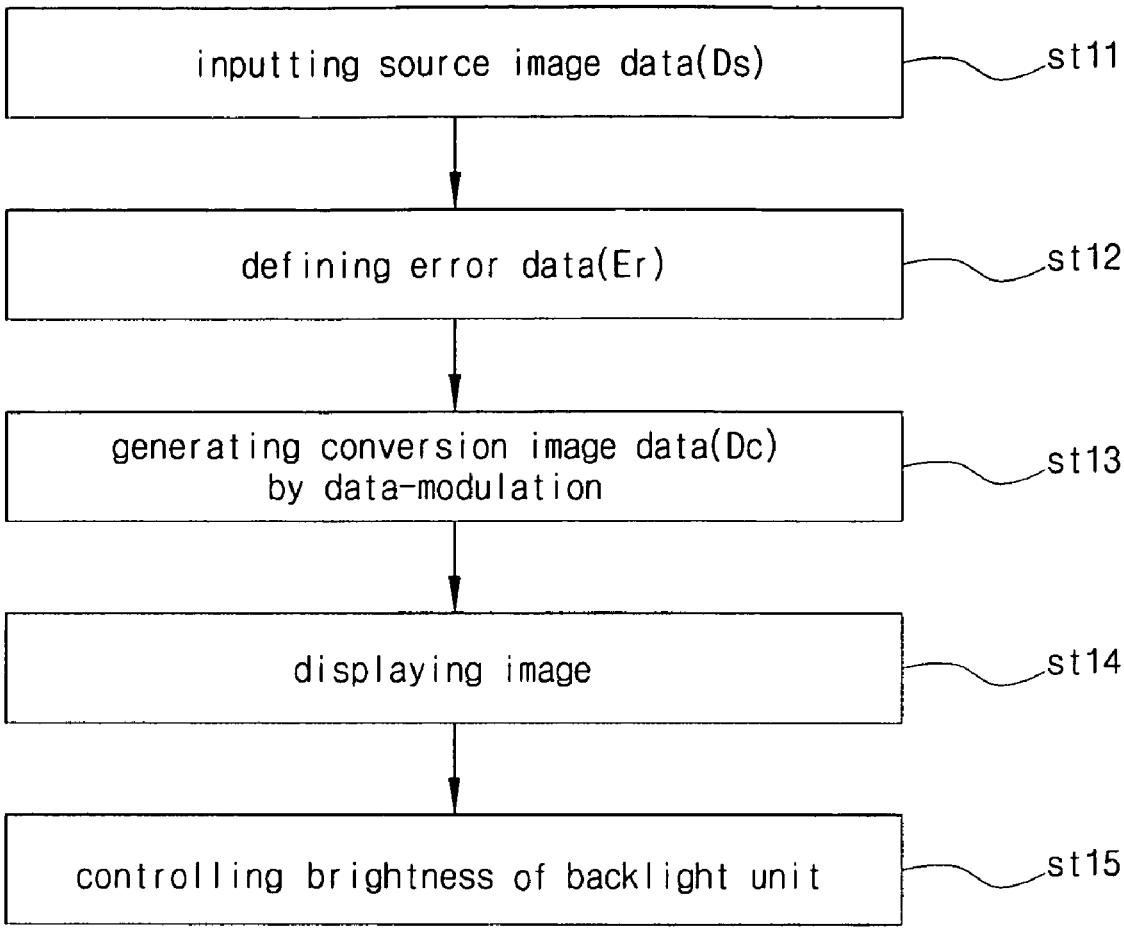
FIG. 2 RELATED ART
FIG. 2 is a flow chart of illustrating a method of driving an LCD device according to a second embodiment of the related art.
Figure 3:
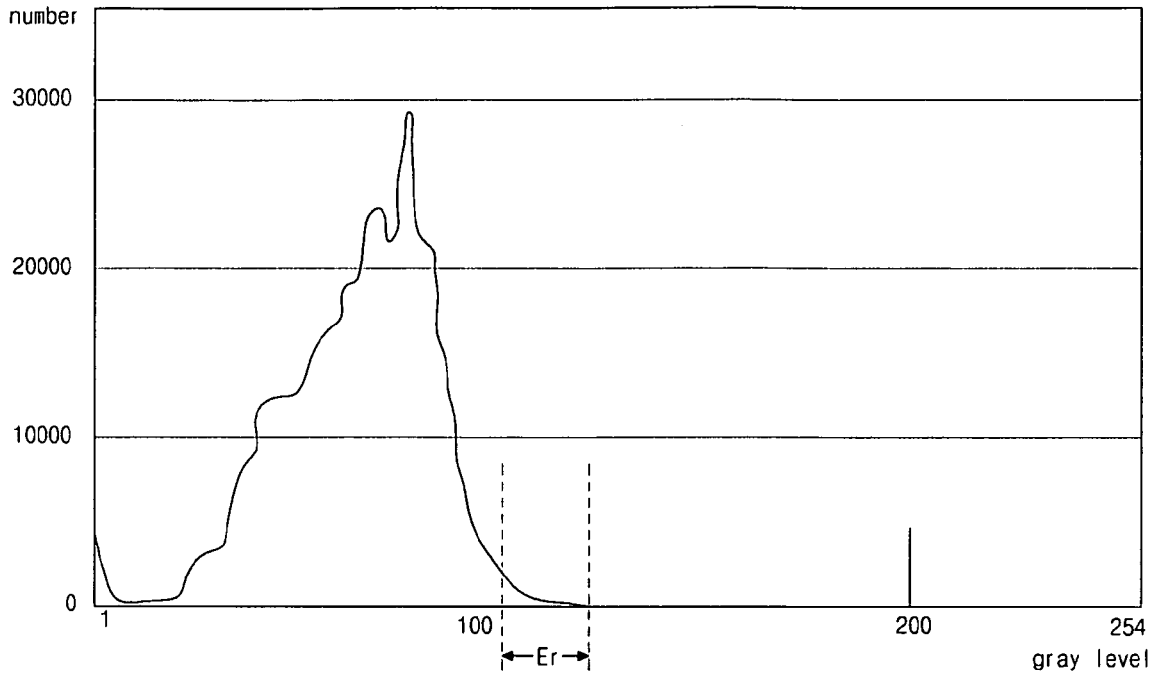
FIG. 3 RELATED ART
FIG. 3 is a view of illustrating a histogram for source image data in a method of driving an LCD device according to the second embodiment of the related art.
Figure 4:
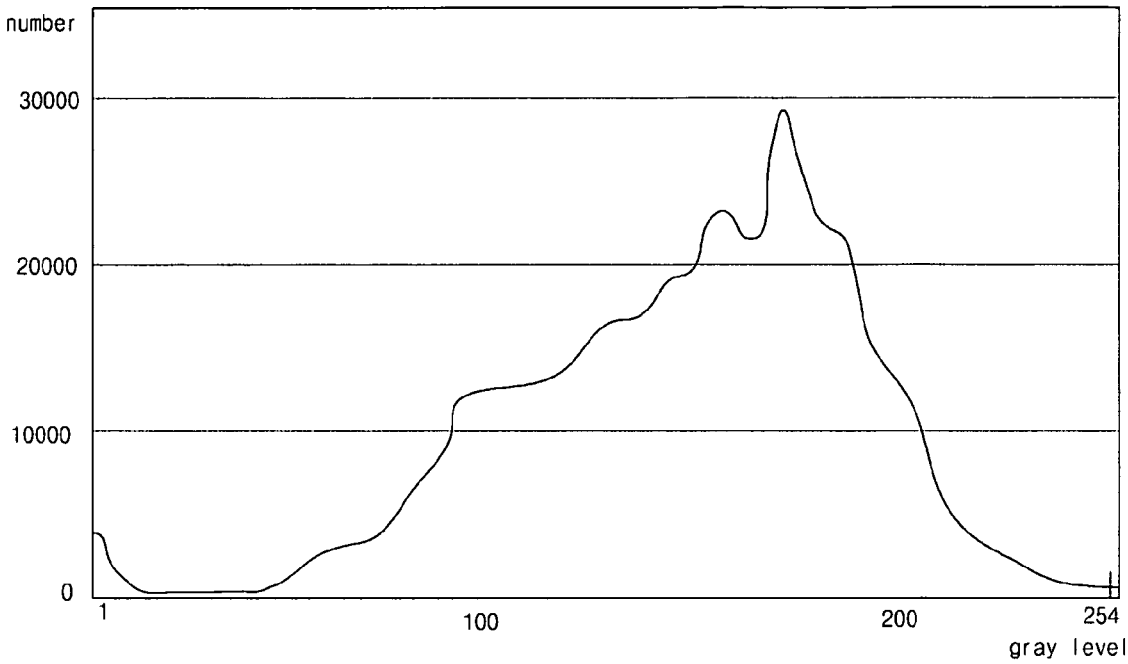
FIG. 4 RELATED ART
FIG. 4 is a view of illustrating a histogram for conversion image data in a method of driving an LCD device according to the second embodiment of the related art.
Figure 5:
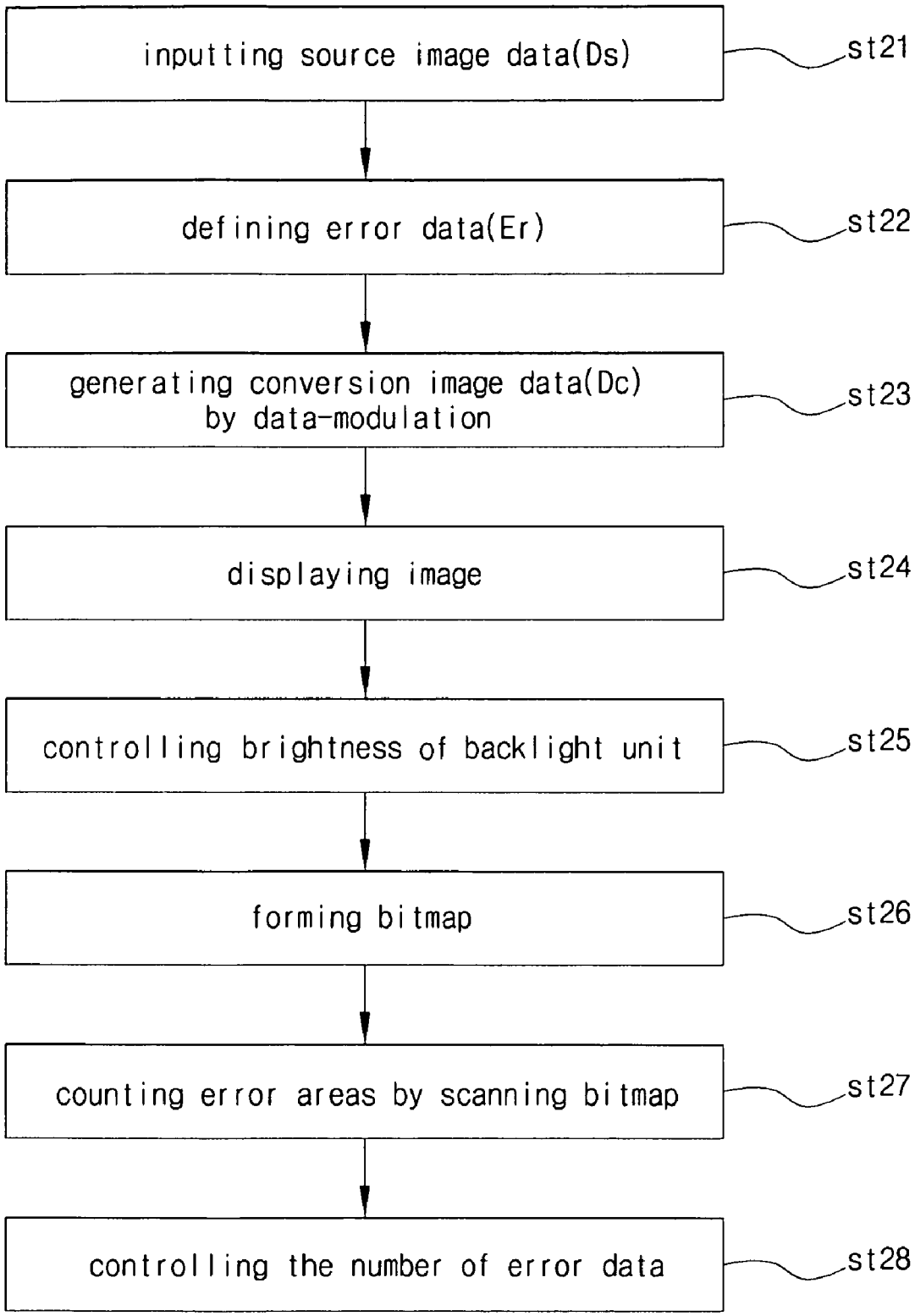
FIG. 5 is a flow chart of illustrating a method of driving a liquid crystal display (LCD) device according to an exemplary embodiment of the present invention.

FIG. 5 is a flow chart of illustrating a method of driving a liquid crystal display (LCD) device according to an exemplary embodiment of the present invention.

Referring to FIG. 5, at step st21, source image data Ds corresponding to one frame, each of which has one of m gray level values (m is a natural number), are inputted as n bit digital data (n is a natural number) from exterior circuits such as a timing controller. Here, m is $2^n$, and the inputted source image data Ds are R, G, and B color image data that are supplied to a liquid crystal panel to produce an image. For example, the source image data Ds may be 8 bit digital image data for 256 gray levels. That is, n may be 8, and m may be 256. In a QVGA (Quarter Video Graphics Array) model having 320×240 pixels, each of which includes three sub-pixels, the number of the source image data Ds is 76,800×3.

Next, at step st22, T source image data (T is a natural number), which have top some gray level values from the largest gray level value, are defined as error data Er. The number of the error data Er, that is, T can be changed according to the property and size of the liquid crystal panel and the characteristics of the image.

At step st23, a maximum image data Dmax is determined by detecting one having the largest gray level value from the source image data Ds excluding the error data Er. The maximum image data Dmax is data-modulated such that the maximum image data Dmax has the maximum gray level value, that is, the mth gray level value, and thus a modulation factor is calculated. The modulation factor s has the same meaning as a gain. Next, conversion image data Dc are generated by data-modulating each of the source image data Ds, that is, by multiplying each of the source image data Ds by the modulation factor s. For example, in the QVGA model, each of 76,800×3 source image data is data-modulated by s times. Here, the error data Er may be data-modulated such that the data-modulated error data have the maximum gray level value, that is, the mth gray level value. The error data Er have gray saturation properties.

Through the steps st21 to st23, the source image data Ds are converted into the conversion image data Dc having increased gray level values.

At step st24, the conversion image data Dc are inputted into the liquid crystal panel to display an image. Accordingly, the image displayed on the liquid crystal panel by the conversion image data Dc has a higher brightness than an image by the source image data Ds.

At step st25, a brightness of a backlight unit is controlled by the modulation factor s, which is used for generating the conversion image data Dc, simultaneously with inputting the conversion image data Dc into the liquid crystal panel. Here, the brightness of the backlight unit is decreased by more than 1/s times. Therefore, the power consumption is reduced.

As step st26, a bitmap for showing positional distribution of pixels corresponding to the error data Er is made out by receiving feedback from the conversion image data Dc, which are inputted into the liquid crystal panel to display the image.

Figures 6, 7:
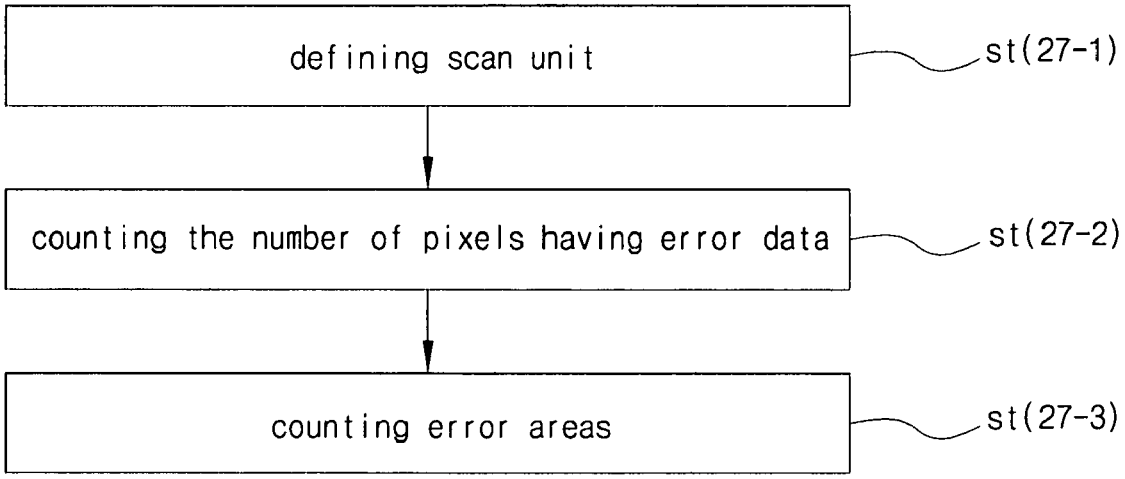
FIG. 6 is a view of illustrating a bitmap for explaining a method of driving an LCD device according to the present invention.
FIG. 7 is a flow chart of illustrating a step of counting error areas in a method of driving an LCD device according to the present invention.

FIG. 6 is a view of illustrating a bitmap for explaining a method of driving an LCD device according to the present invention. In the bitmap of FIG. 6, pixels receiving the error data Er are displayed as 1, and pixels receiving the data excluding the error data Er are displayed as 0. The bitmap shows positional distribution of the error data Er, which are included in the conversion image data Dc inputted into the liquid crystal panel, more particularly, the positional distribution of pixels receiving the error data Er. Since the image quality may be degraded when the error data Er having the gray saturation properties are densely disposed around a specific position, the bitmap is used to detect a position that is able to be degraded.

Next, at step st27, to detect an area, in which the pixels receiving the error data Er are concentrated on the bitmap and may be degraded, the bitmap is scanned, and error areas are counted. The bitmap may be scanned by a resolution of A×B.

The step st27 will be explained in more detail with reference to FIG. 7. FIG. 7 is a flow chart of illustrating a step of counting error areas in a method of driving an LCD device according to the present invention.

At step st(27-1), to scan the bitmap, a size of an area to be scanned, that is, a scan unit, is determined. The scan unit may have a resolution of A×B, for example, a resolution of 4×4. Here, the resolution of 4×4 is a minimum size in which the image degradation due to the gray saturation can be recognized by eyes of a viewer.

At step st(27-2), while the bitmap is scanned by the scan unit of 4×4, the number of the pixels having the error data Er is counted in each scan unit.

Figure 8:
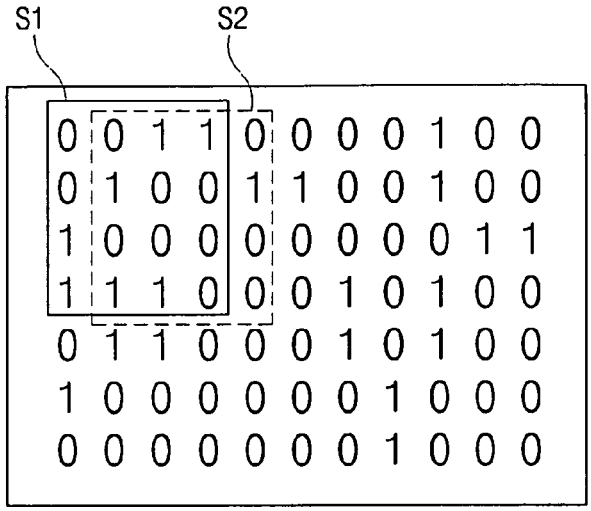
FIG. 8 is a view of illustrating a step of scanning a bitmap in a method of driving an LCD device according to the present invention.

FIG. 8 is a view of illustrating a step of scanning a bitmap in a method of driving an LCD device according to the present invention. In FIG. 8, the bitmap is scanned by the scan unit of 4×4 such that a first scan unit S1 and a second scan unit S2 next to the first scan unit S1 have a maximum overlap region. According to this, a crowded rate of the pixels having the error data Er can be identified.

At step st(27-3), error areas are judged and counted by numbering the pixels having the error data Er in each scan unit. In the scan unit of 4×4 , 16 bitmap data, that is, 16 pixels are included. When there are 14 pixels having the error data Er in the scan unit, the image quality is able to be readily degraded, and thus the corresponding area can be determined as an error area.

The error area can be defined by the following equation (1).

$$(A\times B)/2 \leqq Q \leqq (A\times B) \qquad \text{equation (1)}$$

Here, (A×B) is a resolution of the scan unit, and Q is the number of the pixels having the error data Er in the scan unit. When the pixels having the error data Er are more than 50% of the bitmap data in a scan unit, for example, more than 8, the scan unit may be defined and counted as an error area.

In the present invention, every scan unit in the bitmap is scanned and considered because first and second bitmaps of the same resolution have difference in the number of the error areas even if the first and second bitmaps include the same number of pixels having the error data Er. That is, the denser the pixels having the error data Er are, the more error areas are counted. Thus, the image quality may be readily degraded. Accordingly, the scanning method of the present invention enables the possibility of degradation of the image quality to be easily recognized.

Next, at step st28, after counting the number of the error areas in the bitmap by the above-mentioned method, the number of the error data Er, that is, T is controlled according to the number of the error areas. Many error areas mean that the pixels having the error data Er are densely disposed in a specific region and there are many gray saturation areas. This also means high possibility of degradation of the image quality. Accordingly, to prevent degradation of the image quality and reduce power consumption, the error data Er are newly set up.

Figure 9:
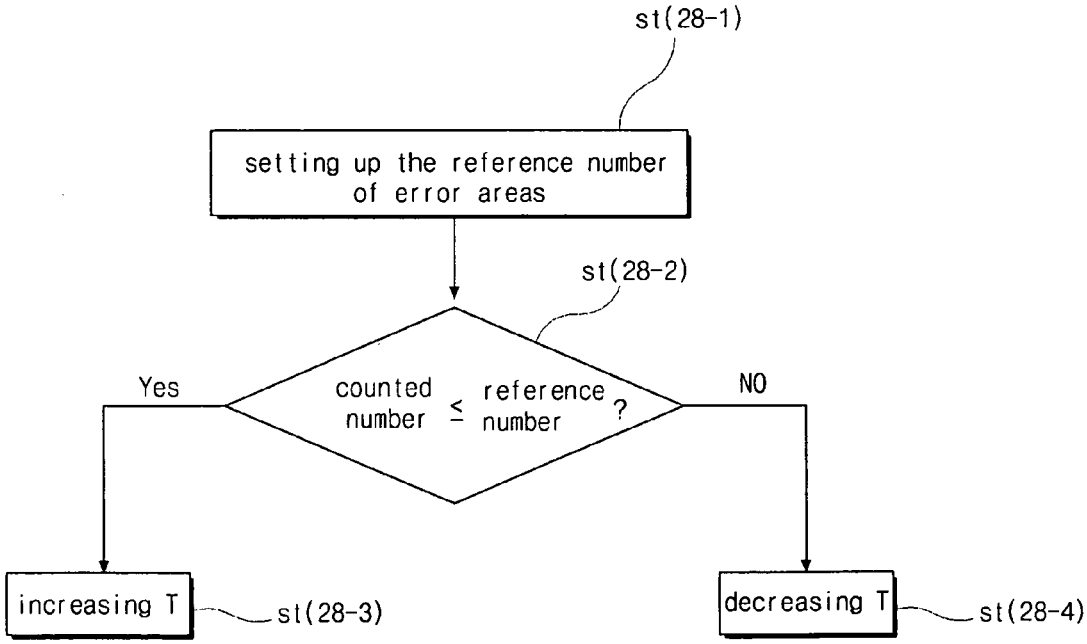
FIG. 9 is a flow chart of illustrating a step of controlling error data in a method of driving an LCD device according to the present invention.

A step of controlling the error data Er will be explained with reference to FIG. 9. FIG. 9 is a flow chart of illustrating a step of controlling error data in a method of driving an LCD device according to the present invention.

In FIG. 9, at step st(28-1), the reference number of the error areas is set up by a designer.

At step st(28-2), the number of the error areas counted by the bitmap scan is compared with the reference number.

At step st(28-3), when the number of the counted error areas, that is, the counted number is less than the reference number, the number of the error data Er, that is, T is increased. At step st(28-4), when the counted number is above the reference number, the T is decreased.

Since the number of the error areas is proportional to the measure of recognizing degradation of the image quality, the number of the error data Er is decreased, and the number of the error areas is reduced to thereby lower the measure of recognizing degradation of the image quality.

The less the number of the error data Er is, the more the number of displayed gray level is. In addition, the number of the error areas is reduced. Therefore, the image quality is improved.

Alternatively, when the number of the error areas is less than the reference number, the system satisfies the intention of the designer, and thus there is a margin for increasing the number of the error areas. Accordingly, the number of the error data Er, i.e., T is increased, and the modulation factor s can be larger. The power consumption of the backlight unit is further decreased without lowering the image quality.

Figure 10:
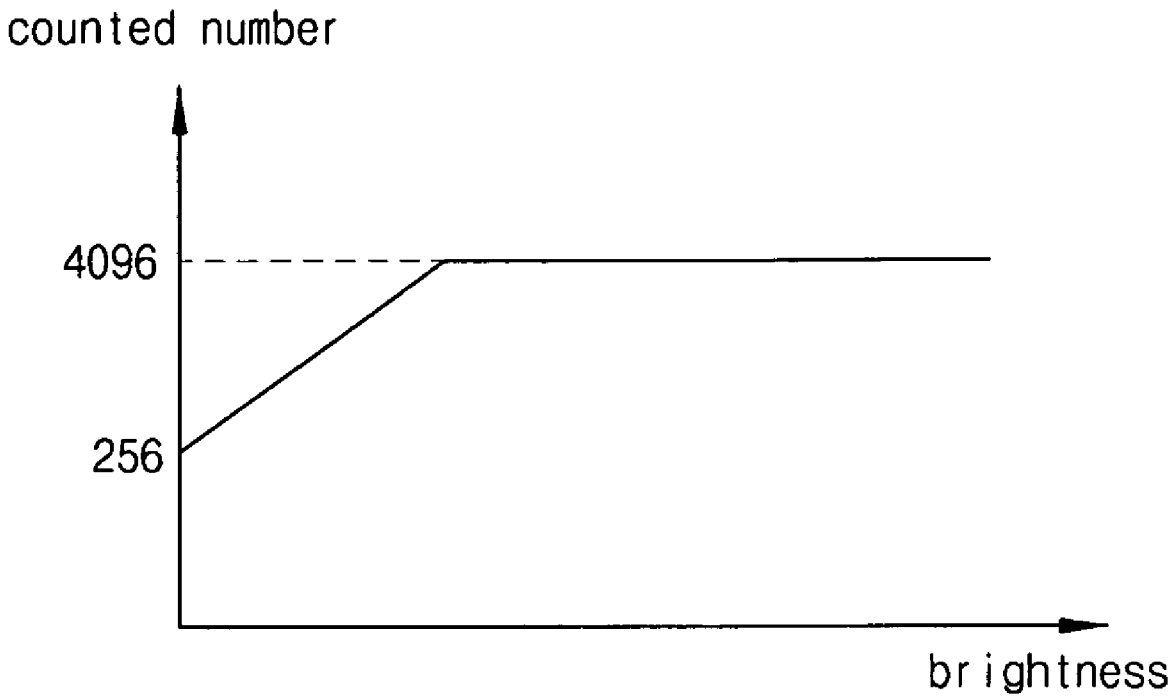
FIG. 10 is a view of illustrating an example of setting up the number of error areas in a method of driving an LCD device.

The number of the error areas can be varied according to the size of the liquid crystal panel or the feature of the displayed image. FIG. 10 is a view of illustrating an example of setting up the number of error areas in a method of driving an LCD device. Referring to FIG. 10, in a liquid crystal panel having a resolution of 1,366×768, when the number of the error areas is more than 256, brightness of the liquid crystal panel is increased, and when the number of the error areas is more than 4,096, the brightness of the liquid crystal panel is little changed and is saturated. Accordingly, in the liquid crystal panel of 1,366×768, it is desirable to control the number of the error areas within a range of 256 to 4,096.

In the present invention, the source image data are converted into the conversion image data such that the conversion image data have increased gray level values, and an image is displayed by the conversion image data. Therefore, the power consumption of the backlight unit is decreased.

Moreover, by controlling the number of the error data using a bitmap, degradation of the image quality is effectively prevented.

Meanwhile, a user can select a driving mode of an LCD device according to their purposes. That is, the user may choose an advanced mode explained above or a normal mode. For example, when the user watches moving images, etc., the user may choose the advanced mode and drive the LCD device to improve the brightness and reduce the power consumption. Alternatively, when the user performs graphics which require accurate expressions in gray level, the user may choose the normal mode and drive the LCD device, whereby exact images are displayed without data-modulation and change in an output signal for the backlight unit.

Therefore, when the user uses the LCD device with the advanced mode, to improve the brightness and power consumption, the source image data are data-modulated, and a control signal for the backlight unit is generated. On the other hand, when the user uses the LCD device with the normal mode, the LCD device is driven without control of the backlight unit and the data-modulation of the source image data. To do this, a pin for controlling the advanced mode and the normal mode may be included in the LCD device.

In a detail driving method of the advanced mode, when the user chooses the advanced mode, the pin in the LCD device receives an ON control signal. Then, the source image data are data-modulated, and it is controlled for the backlight unit to emit light. More particularly, the source image data, each of which has one of m gray level values (m is natural number), are inputted, and the conversion image data are generated from the source image data. The step of generating the conversion image data includes defining T error data (T is natural number) from T source image data which have top k gray level values (k is natural number) from the largest gray level value, generating the conversion image data such that one having the largest gray level value from the source image data Ds excluding the error data has the maximum gray level value, inputting the conversion image data into the liquid crystal panel and controlling the backlight unit according to the conversion image data, forming the bitmap which shows positional distribution of the pixels having the error data corresponding to the conversion image data, counting the error areas which include more than the predetermined number of the pixels having the error data by scanning the bitmap, and controlling the number of the error data, T, according to the number of the error areas.

In a detail driving method of the normal mode, when the user chooses the normal mode, the pin in the LCD device receives an OFF control signal. Differently from the advanced mode, the source image data are not data-modulated and are inputted into the liquid crystal panel. In addition, light-emitting in the backlight unit is not controlled.

In the LCD device according to the present invention, the driving mode can be selectively chosen as occasion demands, and when the LCD device is driven as the advanced mode for increasing the brightness and reducing the power consumption, degradation of the image quality can be improved to thereby display more natural images.

It will be apparent to those skilled in the art that various modifications and variations can be made in the method of driving a liquid crystal display device of the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display device, the method comprising:

inputting source image data, each of which comprising one of m gray level values, where m is a natural number;

defining T error data from the source image data, the error data comprising top k gray level values, where T and k are natural numbers;

generating conversion image data comprising larger gray level values than the source image data using one comprising a largest gray level value from the source image data excluding the error data;

inputting the conversion image data to a liquid crystal panel;

controlling a brightness of a backlight unit in accordance with the conversion image data;

forming a bitmap corresponding to the conversion image data, the bitmap showing positional distribution of pixels with the error data;

counting error areas by scanning the bitmap, each of the error areas comprising the predetermined number of the pixels having the error data; and controlling T according to the number of the error areas, wherein the step of counting the error areas comprises:

defining a scan unit comprising a resolution of A×B, where A and B are natural numbers, counting the number of the pixels with the error data in each scan unit of the bitmap, and counting the error areas when the number of the pixels with the error data in each scan unit is more than Q, where Q is a natural number.

2. The method according to claim 1, wherein:

the source image data are n bit digital;

n is a natural number; and m equals $2^n$.

3. The method according to claim 1, wherein the generating the conversion image data comprises:

determining a maximum image data by detecting the one having a largest gray level value from the source image data excluding the error data;

calculating a modulation factor by data-modulating the maximum image data such that the maximum image data comprises the $m^{th}$ gray level value; and generating the conversion image data by multiplying the source image data by the modulation factor.

4. The method according to claim 1, wherein the brightness of the backlight unit is controlled by the modulation factor.

5. The method according to claim 1, wherein the controlling the brightness of the backlight unit comprises decreasing the brightness of the backlight unit.

6. The method according to claim 1, wherein the forming the bitmap comprises:

displaying the pixels with the error data as 1; and displaying pixels without the error data as 0.

7. The method according to claim 1, wherein A and B are 4.

8. The method according to claim 1, wherein Q is more than (A×B)/2 and less than A×B.

9. The method according to claim 1, wherein controlling the T comprises:

setting up a reference number of the error areas;

increasing T when the number of the counted error areas is less than the reference number; and decreasing T when the number of the counted error areas is above the reference number.

10. The method according to claim 1, wherein the source image data correspond to one frame of the liquid crystal panel.

11. A method of driving a liquid crystal display device, the method comprising:

receiving one of ON and OFF signals, where, when the ON signal is received, the method comprises inputting source image data, each of which comprising one of m gray level values, where m is a natural number;

defining T error data from the source image data, the error data comprising top k gray level values, where T and k are natural numbers;

generating conversion image data comprising larger gray level values than the source image data using one comprising a largest gray level value from the source image data excluding the error data;

inputting the conversion image data to a liquid crystal panel;

controlling a brightness of a backlight unit in accordance with the conversion image data;

forming a bitmap corresponding to the conversion image data, the bitmap showing positional distribution of pixels with the error data;

counting error areas by scanning the bitmap, each of the error areas comprising the predetermined number of the pixels having the error data; and controlling T according to the number of the error areas, and wherein, when the OFF signal is received, the method comprises inputting source image data to the liquid crystal panel, and wherein the step of counting the error areas comprises:

defining a scan unit having a resolution of A×B, where A and B are natural numbers, counting the number of the pixels with the error data in each scan unit of the bitmap, and counting the error areas when the number of the pixels with the error data in each scan unit is more than Q, where Q is a natural number.

12. A liquid crystal display device comprising a means for changing the method of driving the liquid crystal display device of claim 11 according to the ON and OFF signals.

* * * * *